United States Patent [19]

Cargill et al.

[11] Patent Number: 4,691,910

[45] Date of Patent: Sep. 8, 1987

[54] DOCUMENT DISPENSER

[75] Inventors: N. Allen Cargill, Warminster; Michail Malashkin, Chalfont, both of Pa.

[73] Assignee: Technitrol, Inc., Philadelphia, Pa.

[21] Appl. No.: 896,071

[22] Filed: Aug. 13, 1986

[51] Int. Cl.[4] ..... B65H 5/06; B65H 3/44

[52] U.S. Cl. ..... 271/3; 271/9; 271/111; 271/122; 271/259; 271/265; 271/270

[58] Field of Search ..... 271/3, 9, 122, 259, 271/265, 270, 110, 111

[56] References Cited

U.S. PATENT DOCUMENTS 4,253,651 3/1981 McInerny ..... 270/58

4,459,052 7/1984 Lundblad ..... 271/9 X 4,474,365 10/1984 DiBlasio ..... 271/3

4,500,084 2/1985 McInerny ..... 271/35

*Primary Examiner*—Richard A. Schacher

*Attorney, Agent, or Firm*—Frank A. Follmer

[57] ABSTRACT

A document dispenser capable of dispensing documents from a plurality of separate bins is constructed of a modular design. The dispenser is constructed by assembling the modules, one for each bin, with each module including an input hopper and a document feeder. The modules are connected together to feed the documents along a common delivery feed path to a stacker which is provided on a module on the dispensing end of the device.

22 Claims, 8 Drawing Figures

10
11
11'
13
14
14'
15
15'
16
16'
17
17'
18
18'
19
19'
24
24'
27
28
28'
30
30'
32
32'
34
34'
36
38
42
54
64a
65a
66
66'
68
68'
70
70'
72
72'
73
73'
76
76'
77
77'
78
78'
79
79'
80
80'
82
82'
84
84'
85'
90
91
92
94
95
112
128
160
161
161'
162
162'
163
163'
164
164'
165
165'
166
166'
170
179
180
5
M1
M1'
M2

FIG. 4
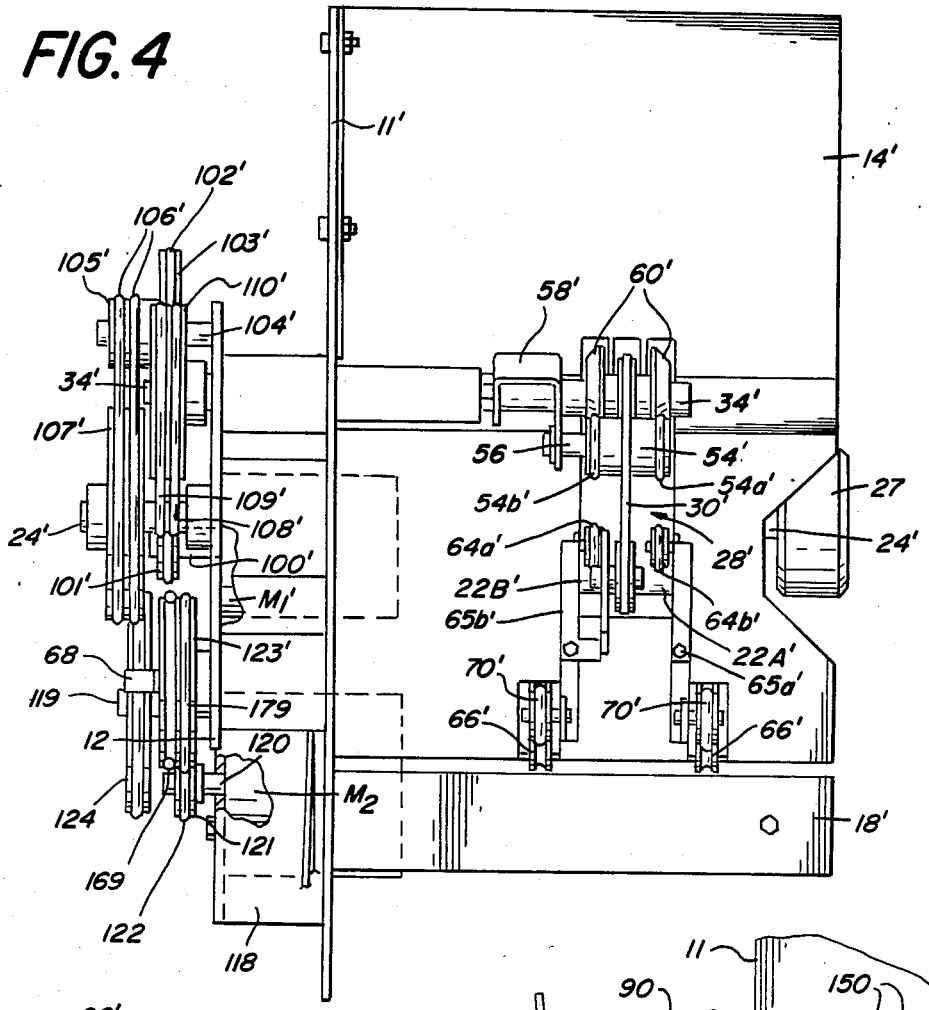
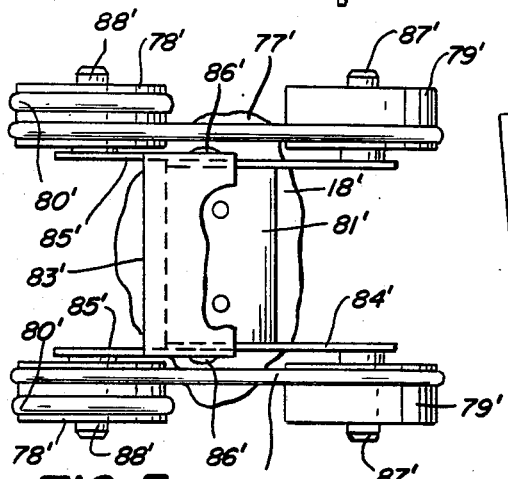
FIG. 5
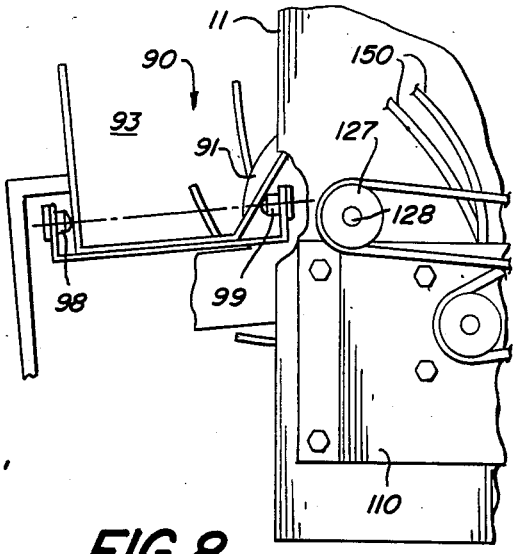
FIG. 8

DOCUMENT DISPENSER

BACKGROUND OF THE INVENTION

This invention relates to document dispensers of the type wherein documents are dispensed from a plurality of separate stacks of documents contained in bins. The document dispenser of the invention is particularly useful for holding and dispensing paper currency on demand from a bank teller and serves to augment or replace a bank teller's cash drawer.

The prior art document dispensers of the type which can be manufactured to operate with different numbers of separate bins are expensive and involve complex document feed paths. The document dispensers of the prior art involve a separate construction for two bin, three bin, four bin, five bin or six bin models with an associated unique conveyer design for the document feed path in each of the models. Accordingly, each model is substantially different from a model having a different number of bins thereby resulting in excessive costs in manufacture and design.

Prior art devices are disclosed in U.S. Pat. Nos. 4,253,651 and 4,500,084.

SUMMARY OF THE INVENTION

It is the general object of the invention to provide a document dispenser capable of dispensing documents from a plurality of separate bins which involves a modular design whereby the need for having a substantially different design for each model of a different number of bins is avoided.

In accordance with a novel feature of the invention, the document feed path of the modular design is such that documents are fed from the bins of some of the modules through a feed path that includes portions of the feed paths of other modules. The modules are constructed and arranged to provide a continuous delivery feed path from module to module and then to a document stacker means.

Briefly stated, the document dispenser of the invention is constructed of modules so that different product models involving different numbers of bins, typically from two to six bins, can be constructed by interconnecting various numbers of standard modules thereby reducing the costs of each model substantially. The dispenser is constructed by assembling the modules, one for each bin, with each module including an input hopper (bin) and a document feeder. The modules are connected together to feed the documents along a common delivery feed path to a stacker which, in the preferred design, is provided on a special feeder/stacker module on the dispensing end of the device. Alternatively, the stacker could be a separate module, and all the hopper/feeder modules have the same construction. The design is such that in order to meet the requirements of two, three, four, five or six bin devices, a like number of modules are interconnected to form the dispenser model. Each dispenser model is fully constructed at the factory where the modules can be interconnected in the appropriate number and combination.

More specifically, the document dispenser in accordance with the invention includes a feeder/stacker module which includes a bin for holding a first stack of documents, a stacker for receiving successively fed documents and stacking them, and means for feeding the documents from the first stack through a first document feed path to the stacker means. The document feeding means includes document feeding and separating apparatus for feeding documents from the first stack so they move individually successively through the initial portion of the first document feed path, document acceleration means for providing a space between the successively fed documents, and document delivery means for feeding the spaced apart documents through a delivery portion of the first document feed path to the stacker means. The document acceleration means and the document delivery means use a common drive component, ie., an acceleration roller means. The document dispenser also includes at least one feeder module which has a bin for holding a second stack of documents and means for feeding the documents from the second stack through a second document feed path. The document feeding means of the feeder module is similar to that of the feeder/stacker module and includes document feeding and separating apparatus for feeding documents from the second stack individually in a successive condition through the initial portion of the second document feed path, document acceleration means providing a space between the successively fed documents, and document delivery means for feeding the spaced apart documents through a delivery portion of the second document feed path into the entrance of the delivery portion of the first document feed path of the feeder/stacker module so that the documents passing from the delivery portion of the second feed path pass into the delivery portion of the first document feed path and to the stacker means.

BRIEF DESCRIPTION OF THE DRAWINGS

FIG. 4 is an elevational view looking from the back end of FIG. 2.

FIG. 5 is a plan view of a detail.

FIG. 8 is a detail view showing part of the stacker means.

DETAILED DESCRIPTION OF THE PREFERRED EMBODIMENT

Figure 1:
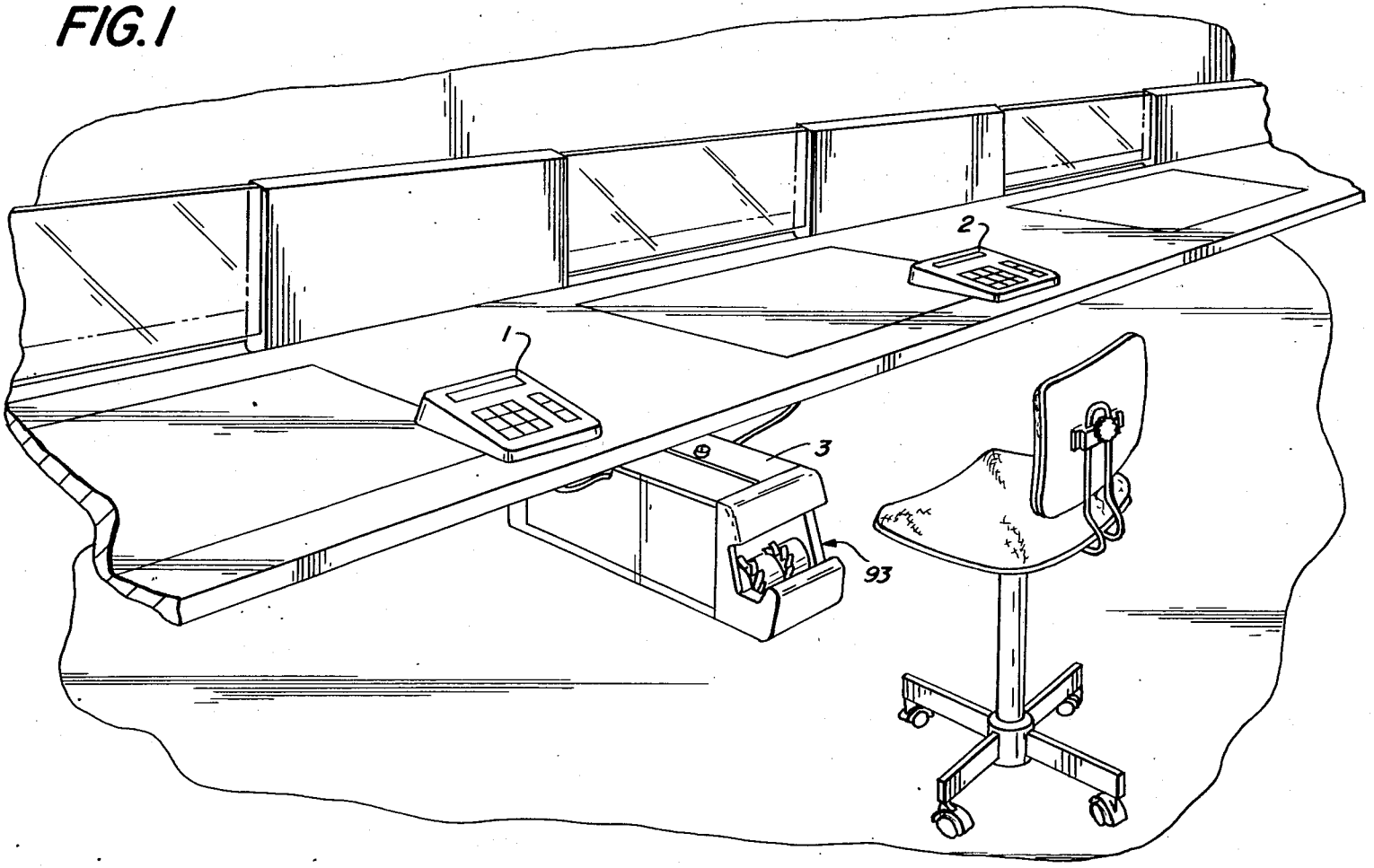
FIG. 1 is a perspective view showing the document dispenser in accordance with the invention arranged to be controlled by two bank tellers.

FIG. 1 illustrates a document dispenser in accordance with the invention arranged to be controlled by two bank tellers by the use of the computer control devices 1 and 2. The mechanism of the dispenser, including the power supply and certain circuitry, is contained within a cabinet 3 provided with a door that can be locked with the same security as a typical cash drawer. The control devices 1 and 2 are provided with keyboards for use by the tellers for controlling the dispensing of paper currency.

Figure 2:
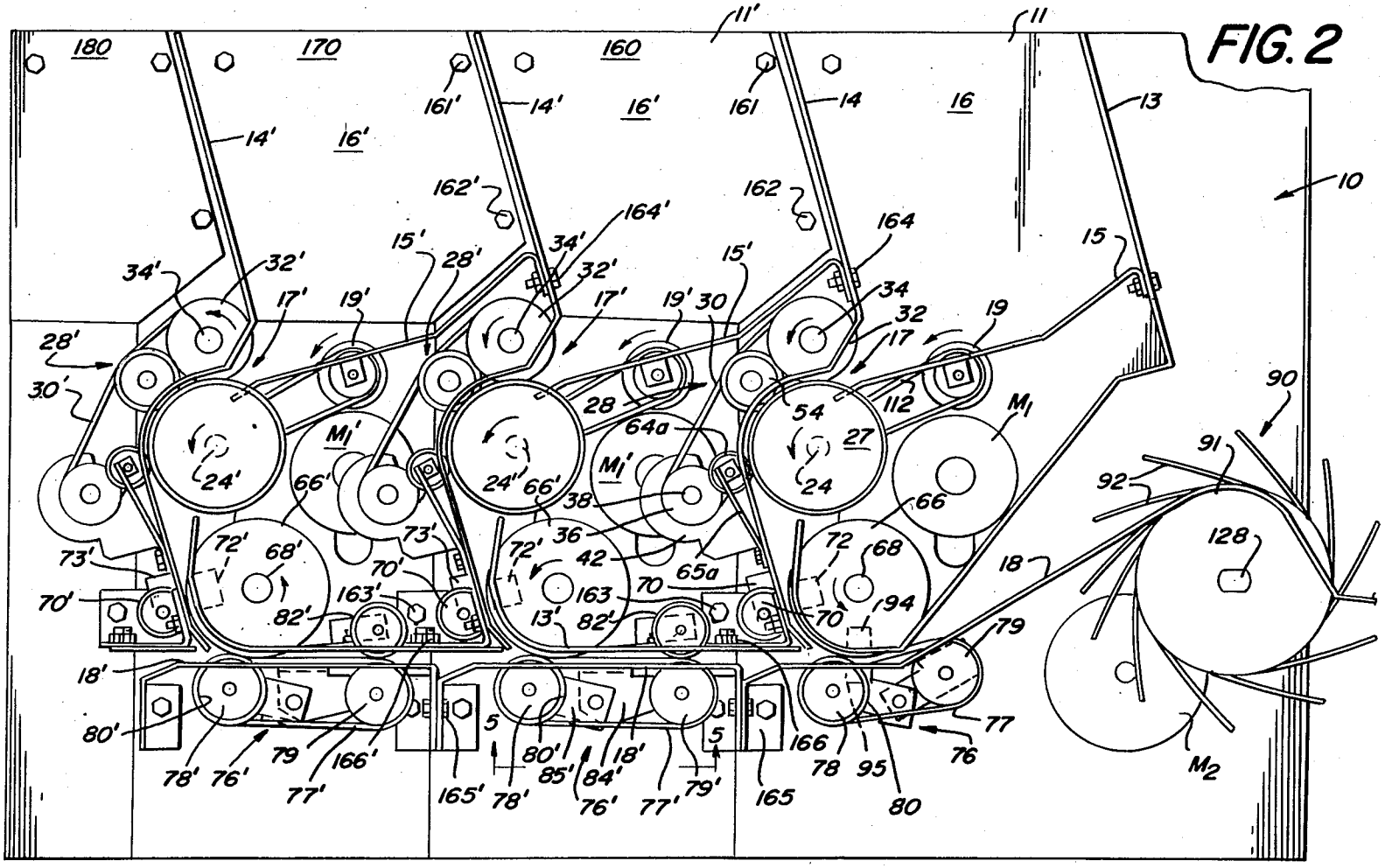
FIG. 2 is an elevational view looking toward the side of the dispenser where the document feeding mechanism of the modules is located.
Figure 3:
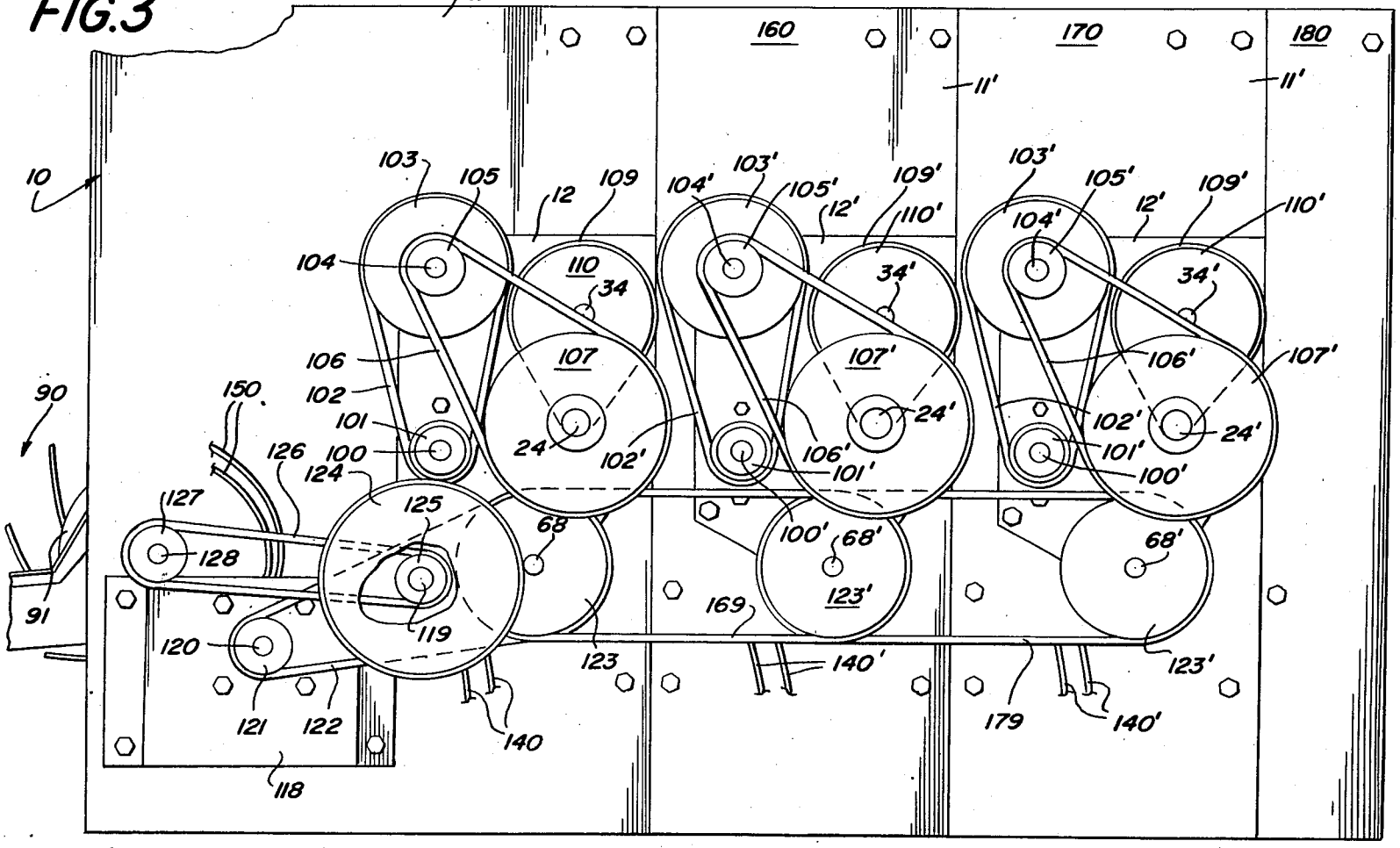
FIG. 3 is an elevational view of the document dispenser looking from the side thereof where the drive means for the document feeding mechanism is provided.

In FIGS. 2 and 3, the cabinet 3 has been omitted so as to illustrate the mechanism in accordance with the invention for a model comprising three bins. The dispenser shown in the drawings comprises a feeder/-stacker module 10 which has a frame which is mounted on a base contained in the cabinet 3 by suitable means (not shown) and includes a vertically extending side plate 11 and a second plate 12 mounted in spaced apart parallel relation to the side plate 11 for supporting the various drive and bearing mechanisms of the dispenser as will be described hereafter. On the document handling side of plate 11, extending transversely therefrom, are two guide plates 13 and 14 extending generally vertically and a shelf 15 extending generally horizontally, although inclined downwardly as is apparent in FIG. 2. The upper portions of plates 13 and 14 and shelf 15 cooperate to define a generally vertically extending bin 16 for receiving a first stack of documents, which stack is inclined to the vertical so as to cause the documents placed in the bin 16 to have the bottom group of documents inclined toward the direction of feed as will be described hereafter. The stack of documents placed on the shelf 15 of the bin 16 rest against the upper portion of plate 14 which provides a back plane. By this arrangement, the bottommost document is fed through an opening 17 into the nip of the document feeding and separating apparatus as will be described hereafter. A bottom guide plate 18 is also mounted on the side plate 11 to extend transversely therefrom and, in cooperation with the bottom portion of guide plate 13, to define the guide path for feeding the documents from a document delivery means to the stacker mechanism as will be described hereafter. Also the lower portions of plates 13 and 14 cooperate to define a guide path for feeding the documents downwardly from the document feeding and separating apparatus to the entrance of the delivery means.

As is shown in FIG. 2, the bin 16 in which the first stack of documents is held consists of a support shelf 15 inclined slightly downwardly from the horizontal towards the back plane and toward the feed path so as to aid the movement of the documents into the feed path. The bottom group of documents in a stack in bin 16 have their movement limited toward the feed path by the portion of plate 14 which is bent slightly in the direction of the document feed and is spaced from the end portion of support shelf 15 to define a throat for the feed of the documents into the feed path.

As discussed above, the bottommost document of the stack is fed through an opening 17 into the nip of a document feeding and separating apparatus which functions to feed single documents successively along the document feed path, which apparatus is the same as that described in detail in U.S. Pat. No. 4,500,084. This apparatus includes a stripper mechanism which operates to prevent more than one document from passing through the feed path at a time and maintains a continuous feed of the documents.

Figure 6:
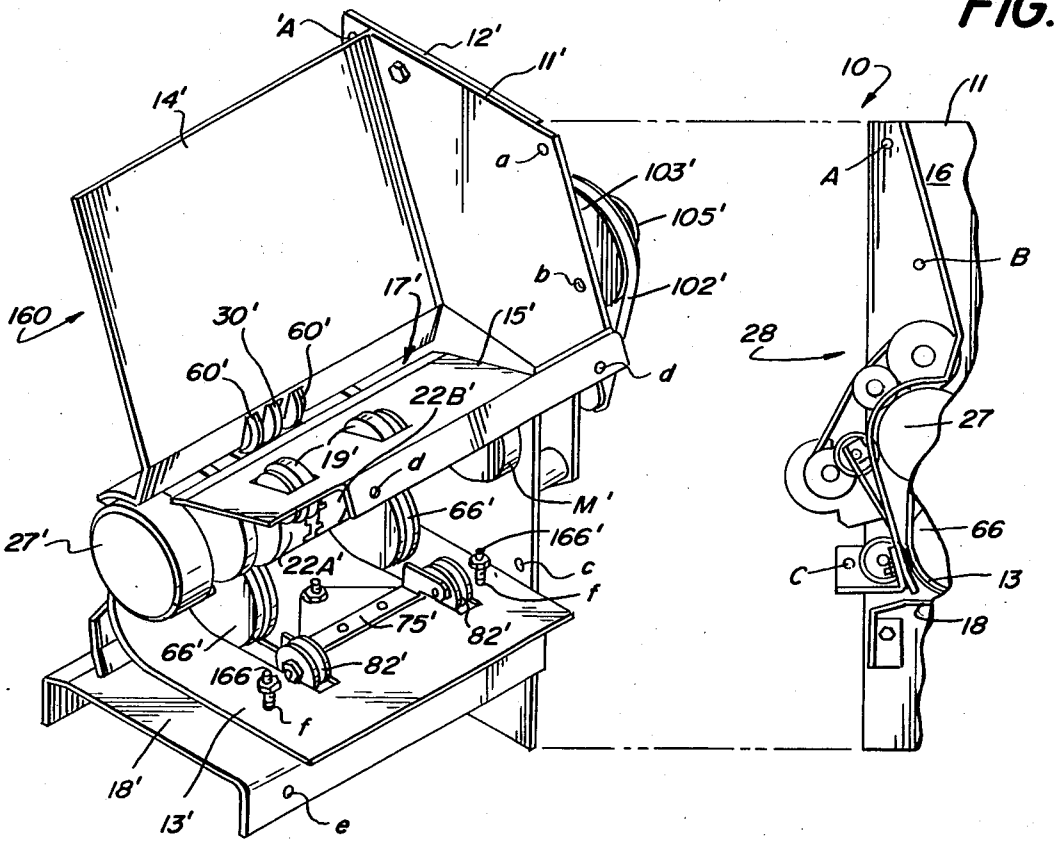
FIG. 6 is a perspective view of a feeder module in preparation for mounting on the dispenser.
Figure 7:
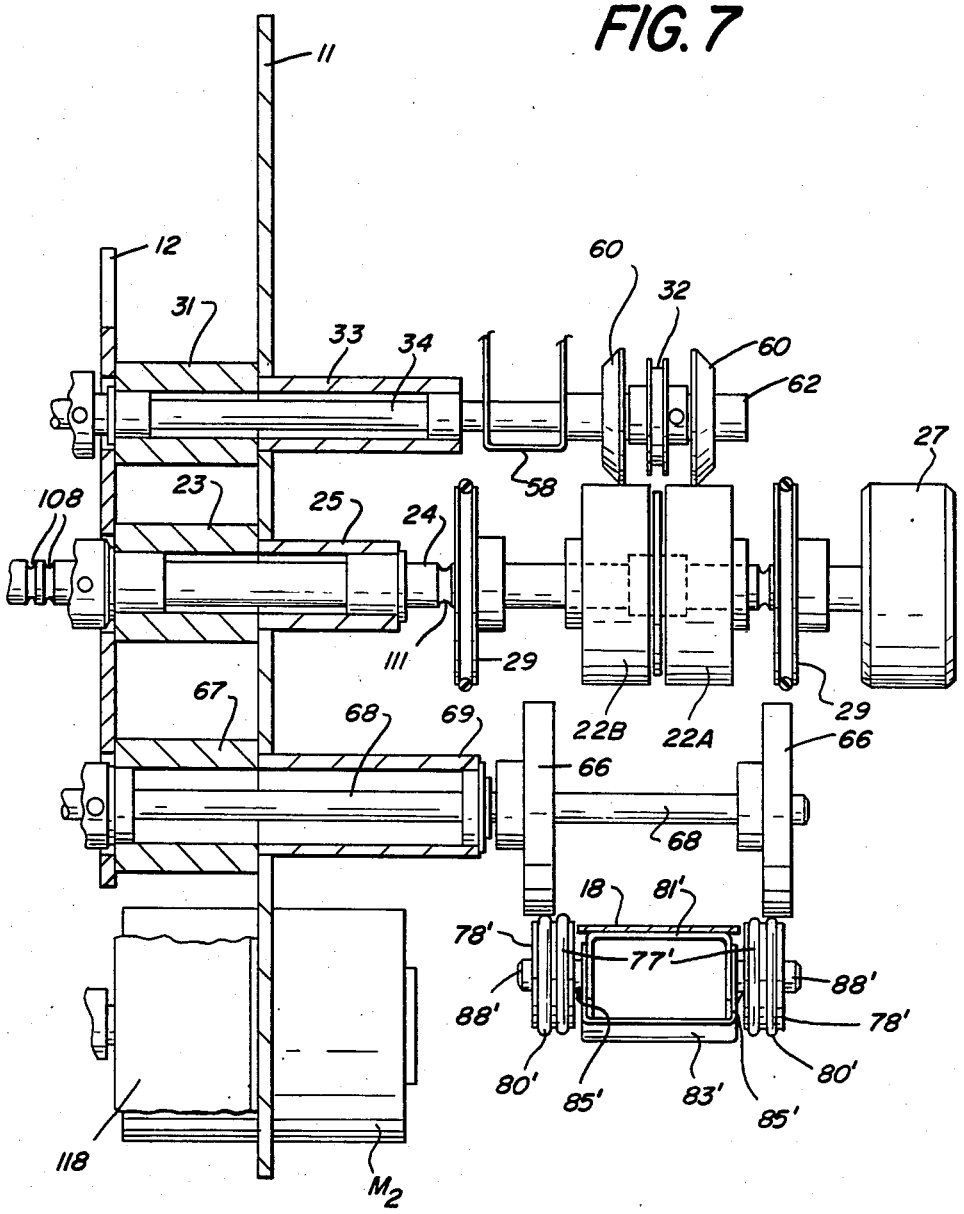
FIG. 7 is an elevational view showing the bearing mounting arrangement for the various feed rollers employed in the feeding mechanism of the document dispenser in accordance with the invention.

The document feeding and separating apparatus comprises a shaft 24 which supports a pair of friction drums or rolls 22A and 22B forming the feed roller means. Shaft 24 is mounted on the dispenser frame by bearings 23, 25 mounted on plates 11 and 12 to be rotated about its longitudinal axis. Friction drums 22A and 22B are fixed to the shaft 24 to rotate together and have high friction tread portions formed at their end portions adjacent to an idler pulley 26 therebetween with the treads being evenly spaced and parallel to the drum axis and the treads of one drum being offset from those of the other as is best shown in FIG. 6. The drums 22A and 22B are separated from one another by a space along the shaft 24 which is occupied by the free-wheeling idler 26, the so called nonfriction belt deflection member. A knob 27 is secured on shaft 24 for manual rotation thereof. As is best shown in FIG. 7, a pair of rollers 29 are mounted on shaft 24 to help feed the documents.

A stripper mechanism 28 comprises stripping friction belt 30 of an elastomeric compound having a cross-section to avoid conforming to the shape of the face of the idler pulley 26 and to minimize forces acting on the document passing the drums 22A and 22B on the drum side of the documents. Friction belt 30 is shown supported at one end on a drive pulley 32 having a rubber friction surface at its outer periphery. Pulley 32 is mounted on a drive shaft 34 rotatably supported on plates 11 and 12 of the frame by bearings 31, 33 for rotation about its longitudinal axis, which is parallel to and spaced from the rotational axis of drums 22A and 22B. The pulley 32 is fixed to the drive shaft 34 which is driven by drive means to be described hereafter and which in turn drives the friction belt 30. Shafts 24 and 34 are driven by the drive means in opposite directions to provide the counter-rotating movement of drums 22A, 22B and belt 30, the parts moving in the direction as shown by the arrows in FIG. 2.

Friction belt 30 is supported at its other end by an idler pulley 36 which is supported on a shaft 38. Pulley 36 is supported on a bracket 42 on the guide plate 14 forming the back plane which is provided with suitable slots to permit passage of the belt 30 and support structure where necessary.

The supporting structure for shaft 38 including the bracket 42 is constructed to provide for adjustment of pulley 36 in a manner and for a purpose described more fully in Pat. No. 4,500,084. Briefly, supporting bracket 42 is part of an angular bracket which is supported by fasteners which enable the device to be moved under a leaverage force to permit the fine tensioning adjustment of the belt 30.

Another pulley 54, the so-called third rotatable means, is rotatably supported on a shaft 56 for rotatable movement in a free-wheeling way. Pulley 54 may be made of a moldable plastic such as "Delrin". Pulley 54 is provided with enlarged diameter rim portions 54*a* and 54*b* which are spaced apart sufficiently to give a wide clearance for the belt 30 so that each rides on a smooth portion of the surface of friction drums 22A and 22B, respectively. The pulley diameter is such as to not contact but remain spaced from belt 30 in the slack belt condition when no document is passing through the feed path, i.e., pulley preferably does not apply to tension to the belt 30 in the position where there is no document passing through the nip of belt 30 and the friction drums 22A and 22B.

Shaft 56 of pulley 54 is supported on an arm of bracket 58 which, in turn, is pivotally supported on shaft 34. The support structure is of such length as to position the pulley 54 in the vicinity of the midpoint of the wraparound of friction belt 30 on pulley 26 intermediate the drums 22A and 22B. The arm of bracket 58 is movable so that rim portions 54*a* and 54*b* can move into contact with the friction surfaces of drums 22A and 22B, respectively, but is designed to permit the idler pulley 54 to move away from the drums as a document passes through. Pulley 54 is of such a diameter that it contacts friction belt 30 at its outside, remote from the friction drums 22A and 22B only slightly, if at all, in the slack condition of the belt 30 when no documents are passing through.

As is described in said Pat. No. 4,500,084, when a document passes between the belt 30 and friction drums 22A and 22B, the pulley 54 is moved outwardly against the belt 30 producing tension on belt 30 at that point, thereby causing a stripping effect acting to separate documents to be increased. The pulley 54 functions to change the tension on belt 30 automatically to handle various documents of various flexibilities as is described in said patent.

The stripper mechanism comprises a pair of stripper idlers 60 each of which is mounted for free-wheeling rotation on stripper shaft 34 by means of a centrally located journal 62 thereof. Pulley 32 for stipper belt 30 is located centrally between stripper idlers 60 which are spaced axially therefrom by spacers as shown in FIG. 7.

Stripper idlers 60 are identical in construction but are mounted on shaft 34 to face in opposite direction as best shown in FIG. 4, each stripper idler 60 having a tubular hub which is secured onto a journal with a pressed fit. Stripper idlers 60 are made of a high friction elastomer and have a generally shallow cup-shaped configuration. The geometry of each stripper idler 60 is such that the resiliency thereof will maintain the proper force or pressure against the feed roller means provided by drums 22A and 22B, or a document positioned between the stripper idlers and the drums, to achieve a document stripping and feeding action as described in said patent. Briefly, the circular rims of the stripper idlers 60 are flexible away from the feed roller means and are constructed and arranged such that when documents are present between the stripper idlers and the feed roller means, a desired pressure is applied to the documents that allows the bottom document to be fed in the desired direction through the apparatus by the feed roller means without creating an excessive force which tends to lock the bottom document by friction to the document thereabove. Thus, stripper idlers 60 assist in the separation of documents from a stack in the bin and assure the separating of adjacent documents in the feeding area. When no documents are present between the stripper idler 60 and drums 22A and 22B, the stripper idlers 60 are driven by drums 22A and 22B to rotate on the stripper shaft 30 on a free-wheeling manner. Drums 22A and 22B and stripper belt 30 are driven in the counter-rotating manner as shown by the arrows in FIG. 2 and as described in said patent. When a stack of documents is placed in the bin 16, they are driven towards the stripper idlers 60 by picker rollers 19 (to be described hereafter). The bottom document in the stack is urged into the nip of the drums 22A and 22B and the counter-rotating stripper belt 30. When a document passes between the stripper idlers 60 and drums 22A and 22B, the high friction drive therebetween is greatly reduced by the document. Drums 22A and 22B have a higher friction coefficient than stripper idlers 60 and operate to feed the bottom documents through the feeding area. Stripper idlers 60 will slow down to approximately the speed of the documents receiving in the bin 16 as the bottom document is fed through the apparatus by drums 22A and 22B. In the event that a document having a severely curled leading edge is present in the stack, there is a tendency for this document to be restrained against feeding and fail to enter the feed means initially. The stripper idlers 60 overcome this problem as is discussed in said patent.

By the above-described feed means, single documents are fed successively in edge-to-edge contact around the feed roller means and are guided vertically downwardly by the vertically extending portion of the guide plate 14. A pair of idler rollers **64*a*, 64*b* are mounted on leaf springs 65*a*, 65*b* and are urged toward the surfaces of the drums 22A, 22B, respectively, at the lower portions thereof as best shown in FIG. 2. The successively fed documents pass vertically downwardly from the contact points of the idler rollers 64*a*, 64*b* and drums 22A, 22B along the lower portion of guide plate 14**.

Means are provided for providing a space between the successively fed documents so as to permit counting thereof. Such means comprises a pair of acceleration rollers 66 mounted on a shaft 68 extending horizontally from the side plate 11 and in parallel relation to shafts 24 and 34. Shaft 68 is rotatably mounted in bearing means 67, 69 mounted on plates 11, 12 as best shown in FIG. 7. Each of the acceleration rollers 66 has associated therewith an idler roller 70 mounted, by brackets on the lower end of plate 14, to rotate in contact with the surface of roller 66 as best shown in FIGS. 2 and 4. The documents being fed vertically downwardly from the feed and stripper mechanism pass into the nip of the acceleration rollers 66 and their associated idler rollers 70. The acceleration rollers 66 are driven to rotate at a high speed (about 2.5 times the linear speed of drums 22A, 22B) so as to sequentially space the documents apart from one another once they have been separated by the stripper mechanism as described above. Such spacing of the documents facilitates counting and also enables the location of the leading edge of each document for purposes of checking for doubles and chains. Each document passes successively into the nip of the acceleration rollers 66 and their associated idler rollers 70 where the high friction of the acceleration roller effectively pulls each document away from the feeder/-stripper mechanism. Thus, for a time, the preceding document is moving faster than the following document in order to create a space between sequential documents to facilitate the detecting and counting of the individual documents.

There is provided a document sensing means including a light emitting diode 72 and a detector 73 which sense the leading edge of each document as it passes a reference point in the document feed path at which time a signal is sent to document counting control which records the signal and keeps a count of the documents being fed. The sensing position is preferably at the pinch of the acceleration rollers 66 and their associated idler rollers 70 as is shown in FIG. 2.

The feeder/stacker module 10 is provided with a document delivery means for feeding the spaced apart documents moving around the acceleration rollers 66 through a delivery portion of the document feed path on said module to a stacker means indicated generally at 90. Such means comprises the acceleration rollers 66 and an idler mechanism 76 associated therewith. The idler mechanism 76 comprises a pair of belts 77, each being mounted on a pair of spaced apart pulleys 78 and 79, the parts being mounted on the underside of plate 18 by a bracket arrangement to be described more fully hereafter. The idler mechanism 76 is mounted at a location beneath its associated acceleration rollers 66 such that the belts 77 thereof are urged into contact with the documents passing under the lower portion of acceleration rollers 66. The idler mechanism 76 includes a pair of rollers 80 formed by circular rims mounted on each of the pulleys 78 to the outside of belts 77, the mechanism being mounted so that one roller 80 is urged into contact with one of the acceleration rollers at the lower portion thereof.

The idler mechanism 76 cooperates with the acceleration rollers 66 to receive downwardly moving spaced apart documents and deliver them in a generally horizontal direction along the upper surface of guide plate 18 into engagement with the fingers 92 of a conventional stacker wheel 91 of the stacker means 90. To this end, the lower end of guide plate 14 is bent forwardly to guide the leading edge of the downwardly moving documents into the nip of the acceleration rollers 66 and the associated roller 80 of the idler mechanism 76 as shown in FIG. 2.

It is noted that the acceleration rollers 66 are utilized to perform dual functions. First, the acceleration rollers 66 cooperate with the idler rollers 70 to achieve the spacing apart of the documents as described above. Secondly, the acceleration rollers 66 cooperate with the rollers 80 of the idler mechanism 76 to assist in the delivery of the documents along a generally horizontal path to the stacker means 90.

The stacker means 90 is conventional and comprises a stacker wheel 91 and a plurality (ten) of fingers 93 which function in a conventional manner to deliver the documents into a dispenser tray 93 (see FIG. 1) whereby they can be removed by the operator on the completion of a dispensing operation.

The feeder/stacker module 10 is provided with a second document sensing means including a light emitting diode 94 and a detector 95 which sense the leading edge of each document as it passes between the acceleration rollers 66 and the belts 77 of their associated idler mechanisms 76. As each document successively passes between the diode 94 and detector 95, in the document delivery feed path, a signal is sent to a document counting control which records the signal and keeps count of the documents being fed to the stacker means 90.

The stacker 90 also includes a light emitting diode (LED) 98 and a sensor or detector 99 located such that any document which has been stacked in the tray 93 will break the transmission of light from the LED 98 to the sensor 99. Accordingly, the presence of documents in tray 93 is detected by the sensor 99 and, in an actual embodiment of the invention this information is used by the control means for the document dispenser in three ways:

(1) A second dispense cannot be made until the operator removes the documents from the first dispense.

(2) The stacker 90 is designed to hold a limited number of documents, ie., N documents. When N documents are dispensed, the unit will stop, even if more documents are to be dispensed. When the operator removes the N documents in the tray 93, this is detected and the dispensing of the remainder of the documents to be dispensed can proceed.

(3) The dispenser is designed so that two tellers can operate the unit. When one of these two operators has completed a dispense but has not removed the documents from the tray 93, the other teller is prevented from using the dispenser. When the documents are removed from the tray 93, this is detected by the LED/sensor means whereupon the other teller is permitted to proceed with the dispensing.

The drive system for the document feeding means described above is shown in FIGS. 3 and 4. The drive system comprises a pair of electric motors $M_1$ and $M_2$. Motor $M_1$ is arranged to drive the drive shafts 24 and 34 for the document feeding and stripping apparatus. Motor $M_2$ is arranged to drive the acceleration rollers 66 and the stacker wheel 91.

Motor $M_1$ is mounted to extend through an opening in side plate 11 and is secured to plate 12 with its drive shaft 100 extending outwardly, or to the left, of plate 12 as viewed in FIG. 4. Mounted on drive shaft 100 of motor $M_1$ is a drive pulley 101 which drives a single belt 102 which is arranged to engage and drive large single belt pulley 103 which is rotatably supported on a pin 104 extending outwardly from plate 12. A small diameter double belt pulley 105 is secured to the outer side of the single belt pulley 103 for rotation therewith. The double belt pulley 105 is engaged with a double belt 106 which is arranged to engage and drive a large diameter double belt pulley 107 secured on the outer end of shaft 24 which drives the feed roller means. Inwardly of the large pulley 107, shaft 24 has formed thereon a small double belt pulley portion 108 which engages a double belt 109 which extends upwardly to engage a large diameter double belt pulley 110 mounted on the end of shaft 34 which drives the stripper mechanism.

By the above-described arrangement, motor $M_1$ drives the shaft 24 for the feed roller means by way of pulley 101, single belt 102, pulley 103, pulley 105, double belts 106 and pulley 107. The drive for the stripper mechanism shaft 34 is provided by the belt 109 which interconnects double pulley 108 on shaft 24 and the large pulley 110 on shaft 34. Means are provided for driving the picker rollers 19 directly from the shaft 24. To this end, shaft 24 is provided with two small diameter single pulley portions 111 which engage belts 112 which extend upwardly from shaft 24 to engage pulleys on the picker rolls 19 (see FIGS. 2 and 7).

Motor $M_2$ is mounted on side plate 11 by means of a box-shaped bracket 118 and has its drive shaft 120 extending outwardly of said bracket to carry a small diameter pulley 121 thereon. A single belt 122 is engaged on pulley 121 and extends rearwardly therefrom to engage a large diameter pulley 123 secured on shaft 68 which drives the acceleration rollers 66.

Means are provided for driving the stacker wheel 91. To this end, the outer end of shaft 68 extends beyond the double belt pulley 123 to form a small roller in contact with the surface of the rim of a large diameter pulley 124 rotatably mounted on a pin 119 mounted in plate 12 and extending transversely therefrom. Pin 119 has a small diameter pulley 125 secured to the inside of pulley 124 for rotation therewith. Pulley 125 is arranged to engage a forwardly extending belt 126 which engages a small pulley 127 secured on the end of the drive shaft 128 for the stacker wheel 91. By this arrangement, motor $M_2$ functions to drive the drive shaft 68 for the acceleration rollers 66 as well as the shaft 128 driving the stacker wheel 91.

The electrical lines 140 for supplying power to the motor $M_1$ are shown in FIG. 3. Similarly, the electrical lines 150 for the motor $M_2$ are shown in FIG. 3.

As is best shown in FIGS. 2 and 6, the document dispenser comprises a feeder module 160 positioned adjacent the feeder/stacker module 10. The feeder module 160 is very similar in construction and operation to the feeder/stacker module 10 whereby corresponding parts given the same reference numerals with primes added. The only essential difference between the feeder/stacker module 10 and the feeder module 160 is that the former is provided with the stacker means 90 and the drive means therefor, otherwise, said modules 10 and 160 have essentially the identical document feeding means.

The feeder module 160 is provided with a frame comprising a side plate 11' and a plate 12'. Side plate 11' has mounted thereon a guide plate 14' and a shelf 15' extending in transverse relation therefrom and cooperating with wall 14 of feeder/stacker module 10 to define a bin 16' for receiving a second stack of documents. There is also provided a pair of picker rollers 19' at the bottom of bin 16' for feeding the documents into the nip of the pair of feed rollers 22A', 22B' and the cooperating stripper mechanism 28' including a stripper belt 30' and stripper idlers 60' as described above with respect to the stacker/feeder module 10. Further, a pair of idler rollers **62*a'*, 64*b'* are mounted to cooperate with the feed rollers 22A', 22B' to feed the separated documents individually vertically downwardly to the nip of a pair of acceleration rollers 66' and their associated idler rollers 70'. A delivery feed means includes an idler mechanism 76' associated with each of the acceleration rollers 66' and arranged to cooperate therewith for feeding the spaced apart documents in a horizontal feed path into the entrance of the delivery feed means of the adjacent feeder/stacker module 10. As shown in FIG. 2, the idler mechanism 76' cooperates with a pair of idler rollers 82' mounted on a lower portion of plate 13' by a bracket 75' (see FIG. 6) to cooperate with the forward portion of belts 77'. Idler mechanism 76' and rollers 82' are constructed and arranged to feed the documents horizontally into the nip of the acceleration roller 66 and the idler mechanism 76 of the feeder/stacker module 10. To this end, a pair of guide plates 13' and 18' have opposed portions arranged to extend horizontally and direct the documents in the desired direction as shown in FIG. 2**.

FIG. 5 is a detail view showing idler mechanism 76' used on feeder module 160, as well as a second feeder module 170 to be described hereafter. Idler mechanism 76' is essentially the same as idler mechanism 76 as is shown in FIG. 2. Referring to FIG. 5, idler mechanism 76' comprises a generally U-shaped mounting bracket 81', the base of which is secured to the underside of guide plate 18' (see FIG. 2), with the legs 84' thereof extending vertically downwardly and forwardly therefrom. Another generally U-shaped bracket 83' has its legs 85' pivotally mounted on legs 84' of bracket 81' at pins 86'. The forward ends of the pair of legs 84' have the shafts 87' of pulleys 79' mounted thereon. The rearward ends of the pair of legs 85' have the shafts 88' of pulleys 78' mounted thereon. The belts 77' are made of a resilient stretchable material, idler mechanisms 76' being mounted to place belts 77' in a tensioned condition to provide a spring pressure against the acceleration rollers 66' by rollers 80'.

The drive means for the drive shafts 24' and 34' for the document feeding and separating mechanism of the feeder module 160 comprises a motor $M_1'$ which is mounted on the plates 11' and 12' with its drive shaft 100' extending out from plate 12' and carrying a small pulley 101' thereon. Pulley 101' drives a belt 102' which extends around a pulley 103' rotatably carried on a pin 104' mounted at the upper end of the plate 12'. Pulley 103' has secured thereto a small pulley 105' which drives a belt 106' thereon which also engages a large pulley 107' keyed on the end of the drive shaft 24' for driving the feed rollers 22A', 22B'. Also mounted on shaft 24' is a small pulley 108' keyed on the drive shaft 34' for the stripper mechanism 28' as described above.

The motor $M_1'$ for the feeder module 160 is powered through supply lines 140' shown in FIG. 3. C The drive means for drive shaft 68' for acceleration rollers 66' comprises the motor $M_2$ which drives shaft 68' by means of a belt 169. Belt 169 engages the outside portion of the double belt pulley 123 on shaft 68 and the outside portion of an identical double belt pulley 123' secured on the end of shaft 68' (see FIG. 3).

As best shown in FIG. 6, the feeder module 160 is a complete modular unit and comprises all the document feed means necessary for feeding documents from a stack thereof to the adjacent feeder/stacker module 10. Thus, the feeder module 160 is provided with its own stripper mechanism, its own feed roller mechanism, its own acceleration roller mechanism and its own delivery roller mechanism as discussed above.

In accordance with the invention, the feeder module 160 and the feeder/stacker module 10 are provided with means for locating the two modules adjacent one another in a precise desired position, i.e., a position whereby the parts do not interfere with one another and the modules are as close as possible. To this end, the module frames are provided with overlapping locator portions provided with locator holes which are adapted to be aligned and to receive mounting screws for use in attaching the feeder module 160 onto the feeder/stacker module 10 in the position as shown in FIGS. 2 and 3.

Thus, plate 11 of feeder/stacker module 10 is provided with three locator holes A, B and C which are arranged to be aligned with locator holes a, b and c on plate 11 of feeder module 160, respectively, when the corresponding portions of plates 11 and 11' are placed in an overlapping position. Mounting screws 161, 162 and 163 extend through the aligned holes A-a, B-b and C-c, respectively, for securing the associated overlapping portions of plates 11 and 11' together. Also, a downwardly extending portion of the forward end of shelf 15' of module 160 is provided with a pair of locator holes d which are arranged to be aligned with corresponding locator holes in plate 14 of module 10 with the overlapping portions of shelf 15' and plate 14 being secured together by means of mounting screws 164 extending through holes d. Further, a downwardly extending portion at the forward end of bottom plate 18' of module 160 is provided with a locator hole e which is adapted to be aligned with a corresponding locator hole in a downwardly extending portion at the back end of plate 18 of module 10, with the overlapping portions of plates 18 and 18' being secured together by mounting bolts 165 extending through hole e. Also, a pair of locator holes f are formed in the horizontally extending portion of plate 13' of module 160 and each is adapted to be aligned with a corresponding locator hole in the mounting bracket for idler roller 70 of module 10 with the overlapping portions of plate 13 and said bracket being secured together by means of mounting screws 166 extending through holes f.

Feeder module 160 is provided with a document sensing means including a light emitting diode 72' and a detector 74' which senses the leading edge of each document as it passes a reference point in the document feed path at which time it sends a signal to a document counting control which records the signal and keeps a count of the documents being fed. The sensing position is at the nip of the acceleration rollers 66' and its associated idler 70' as shown in FIG. 2.

As is best shown in FIG. 2, the document dispenser comprises a second feeder module 170 positioned adjacent the first feeder module 160. Since the second feeder 170 module is identical to the first feeder module 160 corresponding parts have been given the same reference numbers. The second feeder module 170 is provided with the same locator holes a–f which mate with corresponding locator holes in the first feeder module 160 for use in positioning and mounting the second feeder module 170 adjacent the first feeder module 160 by mounting screws 161–166 as is best shown in FIG. 2.

A frame 180 is mounted on the back end of the second feeder module 170 to square off the back end of said module and provide a straight sided frame for use in mounting the dispenser's feeder mechanism within the cabinet 3 of the dispenser.

The second feeder module 170 is provided with its own mortor $M_1'$ for driving the shafts for the feed roller means, the stripper mechanism and the picker rollers, this drive means being identical to that described with respect to the first feeder module 160. Also, the drive shaft 68' for the acceleration rollers 66' of the second feeder module 170 is driven from motor $M_2$ by means of a double belt pulley 123' mounted on the end of this shaft and driven by means of a belt 179 arranged to engage the inside portions of a double belt pulley 123' for module 170 and a similar pulley 123' for module 160 as is shown in FIG. 3.

In use, the document dispenser shown in the drawings is adapted to dispense documents from three stacks of documents in the bins 16, 16', 16' of the feeder/-stacker module 10 and the two feeder modules 160,170. By means of the computer control devices 1 and 2, the operation of the drive motors associated with each of the modules is controlled so that the document dispenser will operate to dispense a predetermined number of documents from each of the bins.

In operation, documents from the first stack in bin 16 of module 10 will be fed initially and will move from said first stack through a first document feed path. The documents are fed from the first stack so they move individually in a successive condition through the initial portion of the first document feed path wherein the documents pass between the feed roller means and the stripper mechanism and downwardly toward the acceleration rollers 66. The acceleration rollers 66 cooperate with idler rollers 70 to engage the succesively fed documents to provide a space therebetween and feed them to the entrance of the document delivery means including the delivery idler mechanism 76 and the lower portions of the acceleration rollers 66 cooperating therewith. The documents pass from the entrance of the document delivery means horizontally through said means into the grip of the fingers 92 of the stacker wheels 91.

Next, the documents in the second bin 16' of module 160 are fed in the same manner as described above through a second document feed path with the spaced apart documents passing downwardly from the acceleration rollers 66' and their associated idlers 70' into the entrance of the document delivery means of the module 160, said documents being delivered in a horizontal path by means of the acceleration rollers 66' and the cooperating idler mechanism 76' as described above. The documents pass horizontally from the document delivery means of module 160 into the entrance of the document delivery means of module 10 and pass therethrough into the grip of fingers 92 of stacker wheels 91.

In a like manner, the documents in the third stack in bin 16' of module 170 are fed individually in a successive condition through the initial portion of a third document feed path and downwardly to the acceleration rollers 66' and idlers 70' of module 170 whereat they are separated and fed into the entrance of the document delivery means of feeder module 170, said documents being delivered in a horizontal path by means of the acceleration rollers 66' and idler mechanism 76' of module 170. From this point, the documents pass horizontally from the document delivery means of module 170 into the entrance of the document delivery means of module 160 and pass therethrough and are delivered from the module 160 into the entrance of the document delivery means of module 10, namely, acceleration rollers 66 and the associated idler mechanism 76, which operate to feed the documents to the stacker means 90 as described above.

It will be apparent that the document dispenser can be easily changed to provide additional bins for the feeding of additional stacks of documents. In actual practice, the dispenser will be available to provide anywhere from two to six bins by the addition of feeder modules in the manner described above.

In the use of the document dispenser, the document sensing means 72, 73 or 72', 73' for each of the modules is used to count the documents as well as to check for doubles or chains by the use of means as disclosed in U.S. Application Ser. No. 810,684, filed Dec. 19, 1985. In addition, the provision of the document sensing means 94, 95 in the delivery feed portion of the feeder/-stacker module 10 permits a cumulative count for the documents as well as a redundant check for chains and doubles, again by the use of mechanism as disclosed in said application.

It will be apparent that the document dispenser can be easily constructed to meet the requirements for two, three, four, five or six bins, by providing a like number of modules 10 and 160 to form a dispenser model. Each model is constructed fully at the factory and can be constructed easily from standard modules whereby the cost of each model is less than that of a uniquely designed model.

Also the modular dispenser described herein can provide means for feeding, counting and stacking of documents with the initiation of these functions being provided by a two teller operation as shown in FIG. 1. Moreover, each control device will contain some type of keyboard and control means to provide means for entering amounts of money to be dispensed, to control the other operations of the dispenser, and to provide accounting functions which are associated with the dispensing transactions. Further, the control devices 1 and 2 will be set up in some manner (such as by switches and or changes of the program of the device) to acount for the number of dispenser bins, namely, two, three, four, five or six, and the demonination of currency for each.

It will be apparent that the document dispenser disclosed in FIGS. 1–8 is a perferred embodiment of the invention and that various changes may be made in the construction and arrangement of parts without departing from the scope of the invention as defined by the appended claims. For example, the document dispenser may be hooked up to be operated either by one or two tellers. Also, while the stacker is shown in FIGS. 1–8 as being part of a feeder/stacker module, the stacker could be incorporated in a separate module and all the other hopper/feeder modules could be of the same construction including a document bin and a document feeding means as described above.

What is claimed is:

1. A document dispenser for dispensing documents from a plurality of stacks of documents comprising:

a feeder/stacker module including a frame, means on said frame defining a bin for holding a first stack of documents, a stacker means for receiving successively fed documents and stacking them, and means for feeding documents from said first stack through a first document feed path to said stacker means, said document feeding means being mounted on said frame and including document feeding and separating apparatus for feeding documents from the first stack so they move individually in a successive condition through the initial portion of said first document feed path, document acceleration means for providing a space between the successively fed documents, and document delivery means for feeding the spaced apart documents through a delivery portion of said first document feed path to said stacker means; and a feeder module including a frame, means on said frame defining a bin for holding a second stack of documents, and means for feeding documents from said second stack through a second document feed path, said last-named document feeding means being mounted on said frame and including documeht feeding and separating apparatus for feeding doucments from said second stack so they move individually in a successive condition through the initial portion of said second document feed path, document acceleration means for providing a space between the successively fed documents, and document delivery means for feeding the spaced apart documents through a delivery portion of said second document feed path and into the entrance of said delivery portion of said first document feed path of said feeder/stacker module, whereby the documents fed through said first document feed path pass from said first stack, are separated, and pass through the document delivery means of said feeder/stacker module to said stacker means, and the documents fed through said second document feed path pass from said second stack, are separated, and pass through the document delivery means of said feeder module and then through the document delivery means of said feeder/stacker module to said stacker means.

2. A document dispenser according to claim 1 including mounting means on said frame of said feeder-stacker module including a plurality of locator holes, and mounting means on said feeder module including a plurality of locator holes constructed and arranged to be aligned with said locator holes of said mounting means of said feeder/stacker module for use in mounting said feeder module adjacent said feeder/-stacker module in a position such that said delivery portion of said second document feed path of said feeder module is aligned with said delivery portion said first document feed path of said feeder/stacker module so that documents can be fed from said document delivery means of said feeder module to said document delivery means of said feeder/-stacker module and to said stacker means.

3. A document dispenser according to claim 1 wherein said document acceleration means of said feeder/stacker module includes an acceleration roller means and an idler roller means cooperating therewith for feeding and spacing the documents passing through said first document feed path, said document delivery means of said feeder/stacker module including an idler mechanism which cooperates with said acceleration roller means at said delivery portion of said first document feed path.

4. A document dispenser according to claim 3 wherein said idler mechanism includes a belt means extending along a horizontal path of the lower end of said acceleration roller means for feeding the documents in a generally horizontal direction to said stacker means.

5. A document dispenser according to claim 3 wherein said document acceleration means of said feeder module includes an acceleration roller means and an idler roller means in cooperation therewith for contacting the documents in said second document feed path for spacing the same and said document delivery means of said feeder module includes an idler mechanism cooperating with said acceleration roller means for contacting the documents at said delivery portion of said second document feed path.

6. A document dispenser according to claim 5 wherein said idler mechanism of said feeder module includes a belt means arranged at a lower end of said acceleration roller means for feeding the documents in a horizontal direction to the entrance of said document delivery means of said feeder/stacker module.

7. A document dispenser according to claim 1 including a second feeder module including a frame, means on said frame defining a bin for holding a third stack of documents, and means for feeding documents from said stack through a third document feed path, said last-named document feeding means being mounted on said last-named frame and including document feeding and separating apparatus for feeding documents from said third stack so they move individually in a successive condition through the initial portion of said third document feed path, document acceleration means for providing a space between the successively fed documents, and document delivery means for feeding the spaced apart documents through a delivery portion of said third document feed path and into the entrance of said delivery portion of said second document feed path of said first-named feeder module.

8. The document dispenser according to claim 7 including mounting means on said frame of said first feeder module including a plurality of second locator holes and mounting means on said second feeder module including a plurality of locator holes constructed and arranged to be aligned with said second locator holes of said mounting means of said first feeder module for use in mounting said second feeder module adjacent said first feeder module in a postion such that said delivery portion of said third document feed path of said second feeder module is aligned with said delivery portion of said second document feed path of said first feeder module so that documents can be fed from said document delivery means of said second feeder module to said document delivery means of said first feeder module.

9. A document dispenser according to claim 4 wherein said document feeding and separating apparatus of said feeder/stacker module includes a document stripping means including a feed roller means and a cooperating counter-rotating friction belt means for stripping away and holding back more than a single document trying to pass therebetween.

10. A document dispenser according to claim 4 wherein said idler mechanism includes a stretchable belt mounted on said frame in a stretched condition to be biased into contact with documents passing around said acceleration roller means.

11. A document dispenser according to claim 1 including document sensing means located along said first document feed path at a location after said document separating apparatus to detect a document after said spacing thereof, and a second sensing means on said feeder module located along said second document feed path after said document separating apparatus to detect a document after said spacing thereof.

12. A document dispenser according to claim 11 including a third sensing means located along the first document feed path at said document delivery means to detect a document as it is passing through said document delivery means on the way to said stacker means.

13. A document dispenser for dispensing documents from a plurality of stacks of documents comprising:

a stacker means for receiving successively fed documents and stacking them;

a first document feeder module including a frame, means on said frame defining a bin for holding a first stack of documents, means for feeding documents from said first stack through a first document feed path to said stacker means, said document feeding means being mounted on said frame and including document feeding and separating apparatus for feeding documents from the first stack so they move individually in a successive condition through the initial portion of said first document feed path, document acceleration means for providing a space between the successively fed documents, and document delivery means for feeding the spaced apart documents through a delivery portion of said first document feed path to said stacker means; and a second document module including a frame, means on said frame defining a bin for holding a second stack of documents, and means for feeding documents from said second stack through a second document feed path, said last-named document feeding means being mounted on said frame and including document feeding and separating apparatus for feeding documents from said second stack so they move individually in a successive condition through the initial portion of said second document feed path, document acceleration means for providing a space between the successively fed documents, and document delivery means for feeding the spaced apart documents through a delivery portion of said second document feed path and into the entrance of said delivery portion of said first document feed path of said first module, whereby the documents fed through said first document feed path pass from said first stack, are separated, and pass through the document delivery means of said first module to said stacker means, and the documents fed through said second document feed path pass from said second stack, are separated, and pass through the document delivery means of said second module and then through the document delivery means of said first module to said stacker means.

14. A document dispenser according to claim 13 including mounting means on said frame of said first module including a plurality of locator holes, and mounting means on said second module including a plurality of locator holes constructed and arranged to be aligned with said locator holes of said mounting means of said first module for use in mounting said second module adjacent said first module in a position such that said delivery portion of said second document feed path of said second module is aligned with said delivery portion said first document feed path of said first module so that documents can be fed from said document delivery means of said second module to said document delivery means of said second module and to said stacker means.

15. A document dispenser according to claim 13 wherein said document acceleration means of said first module includes an acceleration roller means and an idler roller means cooperating therewith for feeding and spacing the documents passing through said first document feed path, said document delivery means of said first module including an idler mechanism which cooperates with said acceleration roller means at said delivery portion of said first document feed path.

16. A document dispenser according to claim 15 wherein said document acceleration means of said second module includes an acceleration roller means and an idler roller means in cooperation therewith for contacting the documents in said second document feed path for spacing the same and said document delivery means of said second module includes an idler mechanism cooperating with said acceleration roller means for contacting the documents at said delivery portion of said second document feed path.

17. A document dispenser according to claim 16 wherein said idler mechanism of said first and second modules includes a belt means arranged at a lower end of said associated acceleration roller means for feeding the documents in a horizontal direction.

18. A document dispenser according to claim 13 including a third document feeder module including a frame, means on said frame defining a bin for holding a third stack of documents, and means for feeding documents from said stack through a third document feed path, said last-named document feeding means being mounted on said last-named frame and including document feeding and separating apparatus for feeding documents from said third stack so they move individually in a successive condition through the initial portion of said third document feed path, document acceleration means for providing a space between the successively fed documents, and document delivery means for feeding the spaced apart documents through a delivery portion of said third document feed path and into the entrance of said delivery protion of said second document feed path of said second module.

19. The document dispenser according to claim 18 including mounting means on said frame of said second module including a plurality of second locator holes and mounting means on said third module including a plurality of locator holes constructed and arranged to be aligned with said second locator holes of said mounting means of said second module for use in mounting said third module adjacent said second module in a position such that said delivery portion of said third document feed path of said third module is aligned with said delivery portion of said second document feed path of said second module so that documents can be fed from said document delivery means of said third module to said document delivery means of said second module.

20. A document dispenser according to claim 17 wherein each said idler mechanism includes a stretchable belt mounted on said frame in a stretched condition to be biased into contact with documents passing around an associated acceleration roller means.

21. A document dispenser according to claim 13 including a first document sensing means located along said first document feed path at a location after said document separating apparatus to detect a document after said spacing thereof, a second document sensing means on said second module located along said second document feed path after said document separating apparatus to detect a document after said spacing thereof, and a third document sensing means located on said document delivery means of said first module to detect documents passing therethrough on the way to said stacker means.

22. A document dispenser according to claim 21 wherein said stacker means includes a tray for holding documents stacked thereby, and including a third document sensing means located such that the presence of any documents on said tray will be sensed.

* * * * *